United States Patent [19]

Schmidt

[11] Patent Number: 4,871,034

[45] Date of Patent: Oct. 3, 1989

[54] RAMMER

[76] Inventor: Paul Schmidt, Reiherstrasse 1,, 5940 Lennestadt 1 (Saalhausen), Fed. Rep. of Germany

[21] Appl. No.: 161,018

[22] Filed: Feb. 26, 1988

[30] Foreign Application Priority Data

Apr. 1, 1987 [DE] Fed. Rep. of Germany ..... 3710928

[51] Int. Cl.[4] ..... E21B 1/00

[52] U.S. Cl. ..... 173/90; 175/19; 405/154

[58] Field of Search ..... 173/90, 91, 134; 175/19; 405/184, 154

[56] References Cited

U.S. PATENT DOCUMENTS 4,160,486 7/1979 Kostylev et al. ..... 173/91 X 4,609,052 9/1986 Lewin ..... 173/91

FOREIGN PATENT DOCUMENTS 2369061 5/1978 France .

2571776 4/1986 France .

*Primary Examiner*—Douglas D. Watts

*Assistant Examiner*—James L. Wolfe

*Attorney, Agent, or Firm*—Toren, McGeady & Associates

[57] ABSTRACT

In a rammer for driving in pipes open in the direction of ramming, in which a piston, axially reciprocated in a housing having an impact head, imparts its thrust to the housing, making the impact head integral with the housing allows a shorter rammer to be used without loss of thrust.

2 Claims, 2 Drawing Sheets

RAMMER

TECHNICAL FIELD OF THE INVENTION

The invention relates to a rammer for driving in pipes, in which a piston, axially reciprocated in a housing, imparts its thrust to the housing.

BACKGROUND OF THE INVENTION AND PRIOR ART

Driving in steel pipes, for example protective or line pipes, with the aid of a rammer whose impact point or head engages, directly or by means of a rammer attachment, in the rear end of a steel pipe, generally requires a starting hole or a shaft in which the rammer and steel pipe are prepared for pushing forward into the ground. The hole must have a minimum length given by the sum of the length of the pipe to be rammed in and the length of the rammer (cf. German Offenlegungsschrift 33 26 246).

To reduce the dimensions of the starting hole the lengths of the pipe to be rammed in can for example be shortened: for example instead of 6 m the length can be only 4 m. This however would result in correspondingly more frequent and time-consuming re-fitting of the rammer and connection of the shorter sections of pipe to the finished length. It is therefore sought to make the sections of a steel pipe to be rammed in as long as possible, and a correspondingly longer starting hole is accepted.

The length of the rammer is determined by the thrust needed to push forward the steel pipe, which is applied by the mass of the percussion piston, which may weigh several tons, that is reciprocated in the housing by means of compressed air supplied through a compressed air line. In known rammers externally threaded cylindrical attachments on the impact head and the cover closing the housing at the end opposite the head are screwed into the housing, which has corresponding internal threads. The length over which they are screwed in is thus lost from the stroke of the percussion piston, which means that with a given diameter the length of the housing must be increased for it to be able to receive the length of the percussion piston determined by the mass for the required thrust.

OBJECT OF THE INVENTION

The object of the invention is to provide a housing for a rammer for driving in steel pipes in which the overall length of the rammer can be shortened without loss of thrust.

BRIEF DESCRIPTION OF THE INVENTION

This object is achieved, according to the invention, by providing the housing with a cover closing its rear end, with an internally threaded tubular extension of the cover preferably being screwed onto a threaded end section of the housing. By this simple measure the housing can be shortened, without loss of the length of stroke available for the percussion piston, by the length otherwise required for screwing in.

In the case of a housing integral with the impact head and with a cover screwed on outside, the housing, and therefore the rammer, can, with the same diameter of the housing and percussion piston, be shortened by about twice the external diameter of the housing without the thrust being reduced compared with a conventional rammer.

The impact head can be conical and engage either directly or by means of a rammer attachment and/or an adapter in the rear end of a steel pipe guided horizontally on bearing blocks.

BRIEF DESCRIPTION OF THE DIAGRAMS

The invention will now be described in more detail with reference to an exemplary embodiment shown in the drawings, where FIG. 1 shows a rammer for driving in a pipe horizontally, FIG. 2 show a known rammer in which both the impact head and the lid are screwed into the housing, FIG. 3 shows a rammer according to the invention in which the housing and the impact head are integral and the lid is screwed on to the outside of the housing.

DETAILED DESCRIPTION OF THE INVENTION

Figure 1:
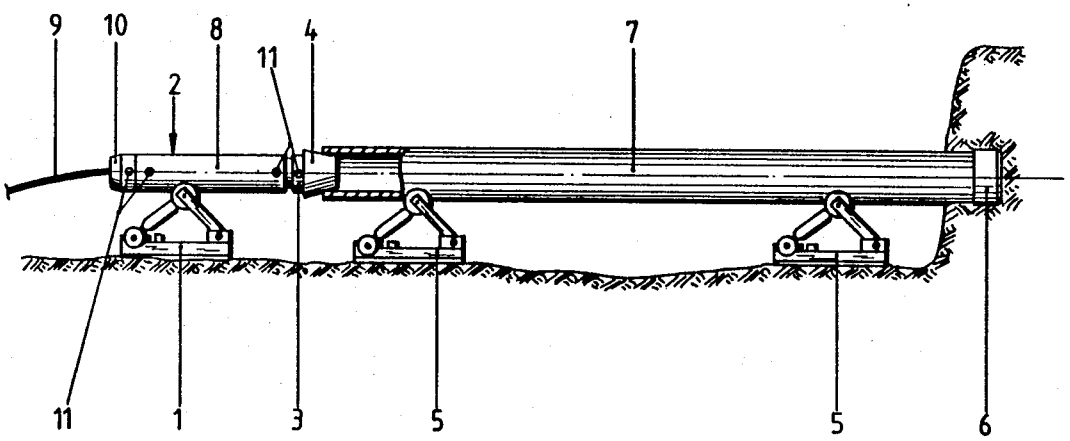

When ramming horizontally, a rammer 2 guided on a bearing block 1 engages with its impact head 3 via an adapter 4 into the rear end of a pipe 7 guided on bearing blocks 5 and provided with a cutting shoe 6 at its front end. A percussion piston (not shown) axially reciprocated inside the housing 8 of the rammer 2 transfers its thrust to the housing 8 or the impact head 3 as well as the adapter 4 and forces the pipe further into the ground with every stroke. The impact head is acted on by means of compressed air which is supplied via a pressure medium connection 10 on the cover 9 of the housing 8; the percussion piston is reversed in the end positions by means of valves 11.

Figure 2:
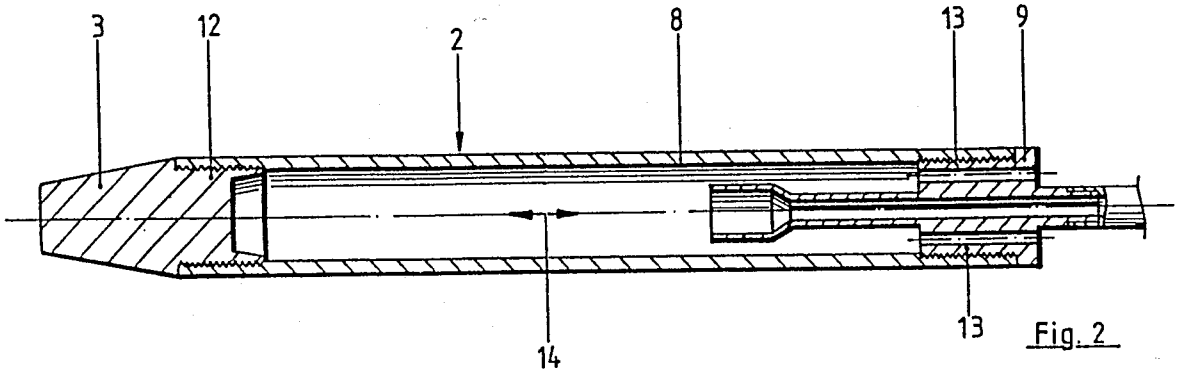

In the rammer 2 shown in FIG. 2 the impact head 3 and the lid 9 are screwed into the housing 8, i.e. both the end sections of the housing 8 have internal threads into which an externally threaded extension 12 of the impact head 3 and a tubular, externally threaded extension 13 of the cover 9 are screwed. The lengths to which the impact head 3 and the lid 9 are screwed in are lost from the length of stroke of the percussion piston which reciprocates in the direction of the arrow 14.

Figure 3:
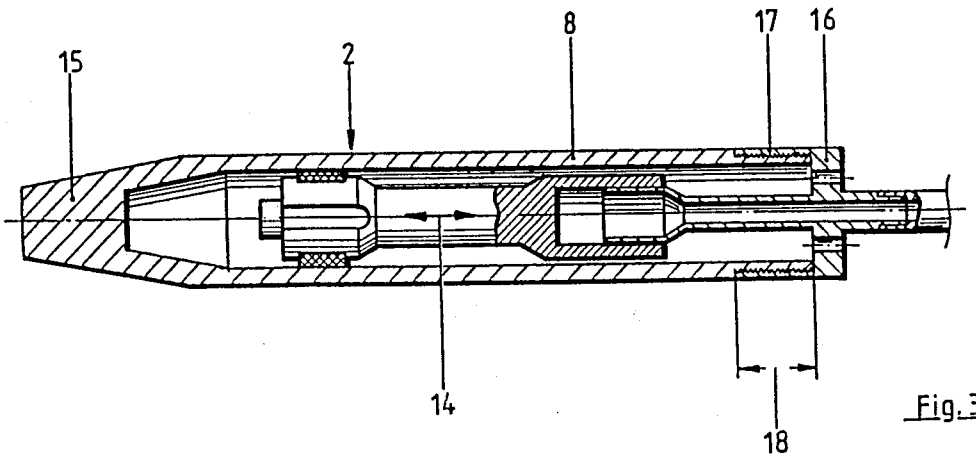

The rammer 2 shown in FIG. 3 has a conical impact head 15 integral with the housing 8, and a cover 16 which has a tubular extension 17 with an internal thread; the tubular extension 17 of the cover 16 is screwed on to an externally threaded end section 18 of the housing 8. Inside the housing 8 there are therefore no screw threads limiting the length of stroke 14 of the percussion piston, so that with a shorter total length of the rammer the same length of stroke and the same thrust is nevertheless available as compared with the very much longer rammer according to FIG. 2.

What is claimed is:

1. A rammer for driving in pipe comprising an axially extending housing having a front end and a rear end and arranged to receive an axially reciprocating piston so that the piston imparts its thrust to an impact head forming the front end of said housing, said housing is threaded at its rear end with a cover in threaded engagement on the rear end, wherein the improvement comprises that said cover (16) has a plate-like member extending transversely of and closing the rear end of said housing and a tubular extension extending in the axial direction of said housing from said plate-like member toward the front end of said housing, said tubular extension having an internal thread screwed onto an externally threaded end section (18) of said housing, said plate-like member having a front side facing toward the front end of said housing and said front side bearing against the rear end of said housing and axially limiting a piston space within said housing.

2. A rammer, as set forth in claim 1, wherein said housing including said impact head is a monolithic member from the front end to the rear end thereof and said housing has a uniform inside and outside diameter between the front and rear ends.

* * * * *